US011782387B2

(12) United States Patent
Bracco

(10) Patent No.: US 11,782,387 B2
(45) Date of Patent: Oct. 10, 2023

(54) PENDULUM DEVICE

(71) Applicant: Andrea Bracco, Chiusavecchia (IT)

(72) Inventor: Andrea Bracco, Chiusavecchia (IT)

( * ) Notice: Subject to any disclaimer, the term of this patent is extended or adjusted under 35 U.S.C. 154(b) by 0 days.

(21) Appl. No.: 17/790,875

(22) PCT Filed: Jan. 8, 2021

(86) PCT No.: PCT/IB2021/050114
§ 371 (c)(1),
(2) Date: Jul. 5, 2022

(87) PCT Pub. No.: WO2021/140474
PCT Pub. Date: Jul. 15, 2021

(65) Prior Publication Data

US 2023/0034623 A1 Feb. 2, 2023

(30) Foreign Application Priority Data

Jan. 10, 2020 (IT) ..... 102020000000334

(51) Int. Cl.
*G04B 17/02* (2006.01)

(52) U.S. Cl.
CPC ..... *G04B 17/025* (2013.01)

(58) Field of Classification Search
CPC ..... G04B 17/02–025
See application file for complete search history.

(56) References Cited

U.S. PATENT DOCUMENTS

| | | | |
|---|---|---|---|
| 2,593,467 | A | 4/1952 | Maar |
| 5,140,565 | A | 8/1992 | Katsma |
| 2012/0227485 | A1 | 9/2012 | Gregory |

FOREIGN PATENT DOCUMENTS

IT UB201543373 U1 11/2016

OTHER PUBLICATIONS

Search Report from corresponding Italian Application No. IT 202000000334, dated Sep. 23, 2020.
International Search Report from PCT Application No. PCT/IB2021/050114, dated Apr. 14, 2021.

*Primary Examiner* — Daniel P Wicklund
(74) *Attorney, Agent, or Firm* — WORKMAN NYDEGGER

(57) ABSTRACT

A pendulum device is provided including at least one oscillating mass, at least one proximal arm, and at least one first distal arm, The at least one proximal arm is fixed to the oscillating mass at one end and is rotatably connected to the distal arm at the other end, so that the oscillating mass can oscillate with respect to said distal arm. The distal arm is rotatably fixed to a support element fixed through a fulcrum point. Furthermore, transmission means are included between the distal arm and the proximal arm. The transmission means is configured so that oscillation of the mass causes the rotation of the distal arm around the fulcrum point and so that at least one point of said proximal arm performs at least a linear translation, the mass performing a cycloidal trajectory.

10 Claims, 8 Drawing Sheets

PENDULUM DEVICE

BACKGROUND

The present invention relates to a pendulum device, comprising at least one oscillating mass, at least one proximal arm and at least one first distal arm.

The proximal arm is fixed to the oscillating mass at one end and is rotatably connected to the distal arm at the other end, so that the oscillating mass can oscillate with respect to the distal arm.

The one just described is the common configuration of pendulums known in the art, i.e., devices which lead a mass suspended by a rigid arm to oscillate by gravitational effect, along a pendulum path.

The oscillation of a suspended mass has been used for centuries for articulating a unit of time. The characteristic for which the pendulum motion is adopted is the isochronism of the oscillations, when they travel an amplitude of a few degrees, within which the circular trajectory is isochronous.

However, oscillations beyond a certain range of degrees produce a period proportional to the amplitude of the oscillation.

State-of-the-art solutions include modifying the path traced by the mass in order to achieve an isochronous oscillation trajectory.

For example, shapes are inserted which arch the flexible suspension of the mass and modify the extension thereof, or suspension systems are used which modify the trajectory of the oscillating arm with the result of compensating for the circular error.

Such solutions allow to create devices which obtain the isochronism of the pendulum oscillations, but always in a certain range of amplitude, albeit greater than the range of the known pendulums, but do not allow conducting a mass along oscillations of any amplitude by means of a fixed arm, whose oscillation period is isochronic, altered only by mechanical and aerodynamic friction and proportional to the instantaneous gravitational attraction.

The motion of gravitational attraction conducted by a mass along a circular path expresses an inharmonic motion, which limits the kinetic energy developed, while the gravitational acceleration conducted along an isochronous trajectory produces a harmonic motion of the mass.

Furthermore, in the devices known in the art, there is a system for compensating the kinetic energy absorbed by mechanical friction and aerodynamic resistance resulting from the movement of the mass.

The mechanical torque of the friction compensation, in the known pendulums, is applied by acceleration pulses at the moment of zero speed, or during oscillation.

State-of-the-art solutions are discussed within the documents U.S. Pat. No. 5,140,565, US2012227485, and ITUB201543373, the contents of which are to be considered an integral part of the present patent application.

There is therefore an unmet need by the devices of the prior art to obtain a pendulum device which allows the isochronism of the oscillations of a mass in the gravitational field to be obtained.

SUMMARY

The present invention achieves the above objects by obtaining a device as described above, in which the distal arm is rotatably fixed to a fixed support element through a fulcrum point.

Transmission means are also included between the distal arm and the proximal arm, configured so that the oscillation of the mass causes the rotation of the distal arm around the fulcrum point and so that at least one point of said proximal arm performs at least one linear translation, making said mass perform a cycloidal trajectory.

A device is thus obtained which, through a rigid arm, conducts a mass, oscillating by gravitational effect, along a pendulum trajectory, which travels in proportion to the kinetic energy available thereto, in an isochronous manner.

In fact, as will be seen later the device comprises a mechanical and aerodynamic friction compensation system, which allows the continuous oscillation of the mass.

The duration of the oscillations is independent of the amplitude, is proportional to the length of the suspension arm and the gravitational acceleration.

The device object of the present invention allows a reciprocal conversion between oscillatory motion, harmonic alternating linear motion, partial or complete circular motion.

Starting from this general concept, there are multiple embodiments which allow to optimize the cycloidal trajectory of the oscillating mass and which will be described in relation to some embodiments illustrated below.

Preferably the value of the distance between the connection point of the mass to the proximal arm and the connection point of the proximal arm to the distal arm is about four times the value of the distance between the connection point of the proximal arm to the distal arm and the connection point between the distal arm and the support element.

According to a preferred embodiment, such a value is precisely four times greater.

Furthermore, according to a possible embodiment, mass motion reversal means are included, which reversal means are configured such that the point on the proximal arm performs two linear translations oriented perpendicular to each other.

According to a first embodiment, the transmission means comprise a first gear provided at the connection between the proximal arm and the distal arm.

The first gear is integral with the proximal arm and engages with a second gear rotatably fixed to the distal arm, which in turn engages with a third gear included at the connection area between the distal arm and the support element.

Some embodiments will illustrate the different embodiments which can be obtained starting from the gear train just described.

Alternatively, the transmission means comprise a first gear engaging with a crown having an inner toothing.

The first gear is integral with the proximal arm, while the crown is integral with the support element, the distal arm being rotatably fixed to the support element.

In order to optimize obtaining the cycloidal trajectory, the crown diameter is preferably about twice the diameter of the first gear.

According to a preferred embodiment, the crown diameter is precisely twice the diameter of the first gear.

Also in this case, further embodiments will illustrate the different embodiments which can be obtained starting from the above-described crown-gear system.

The further features of the device object of the present invention, which will be described below, are aimed at improving the mechanical and kinematic aspects of the pendulum device object of the present invention.

According to an embodiment variant, the support element is connected to at least two distal arms, each distal arm being connected to a proximal arm to which the oscillating mass is fixed.

Furthermore, transmission means are provided between each distal arm and the corresponding proximal arm.

Advantageously, the distal arm has a weight at the end opposite the end facing the proximal arm.

The purpose of such a weight is to balance the masses, so that the resulting oscillating mass is almost only the oscillating mass and not the mass of the arms.

As anticipated, oscillating mass movement means are advantageously included.

Such means can advantageously consist of a mechanical and aerodynamic friction compensation system which allows the continuous oscillation of the mass.

The friction compensation may be carried out continuously or intermittently:

continuously through a coupled inverter, the size of which determines the amplitude of the angle of oscillation of the mass;

intermittently through pulses applied along the circular or linear path during the path of the mass. Between successive acceleration pulses, the mass travels down as a function of instantaneous gravitational attraction.

The duration of the period and the position of the mass can be detected by position sensors, necessary to detect the oscillation speed and adapt the mechanical torque necessary to compensate for friction and allow the continuous movement. For example, such a compensation system can act on the transmission means, during the oscillation of the mass, to actuate a minimum rotation of one or more gears which allows to give a lower thrust than the speed of the mass.

In combination with the embodiment described above, an oscillating mass velocity detection device may be provided so as to adjust the operation of the friction compensation system.

From what has just been described, it is evident that the device just described can be used for various purposes, in addition to that of the simple measurement of time.

The pendulum device object of the present invention can in fact be used as a gravimeter and the peculiar obtaining thereof allows the measurement of the instantaneous variation of gravity in the areas where it is installed.

For this reason, the device object of the present invention can be used for the prediction of earthquakes or tides, events which cause a variation in gravity.

In fact, the gravimeter produced has an isochronous oscillation.

Alternatively or in combination, it is possible to connect the device object of the present invention to a transformer, so as to generate energy, since the device allows to obtain a circular movement with 4 useful phases every 360 degrees.

BRIEF DESCRIPTION OF THE DRAWINGS

These and other features and advantages of the present invention will become clearer from the following description of some exemplary embodiments illustrated in the attached drawings in which.

DETAILED DESCRIPTION OF VARIOUS EMBODIMENTS

It is specified that the figures attached to the present patent application show some possible embodiments of the pendulum device object of the present invention to better understand its advantages and features described.

Such embodiments are therefore to be understood for illustrative purposes only and not limited to the inventive concept of the present invention, namely to obtain a pendulum device which, through a rigid arm, conducts a mass, oscillating by gravitational effect, along a pendulum trajectory, which travels in proportion to the kinetic energy available thereto, in an isochronous manner.

Figure 1:
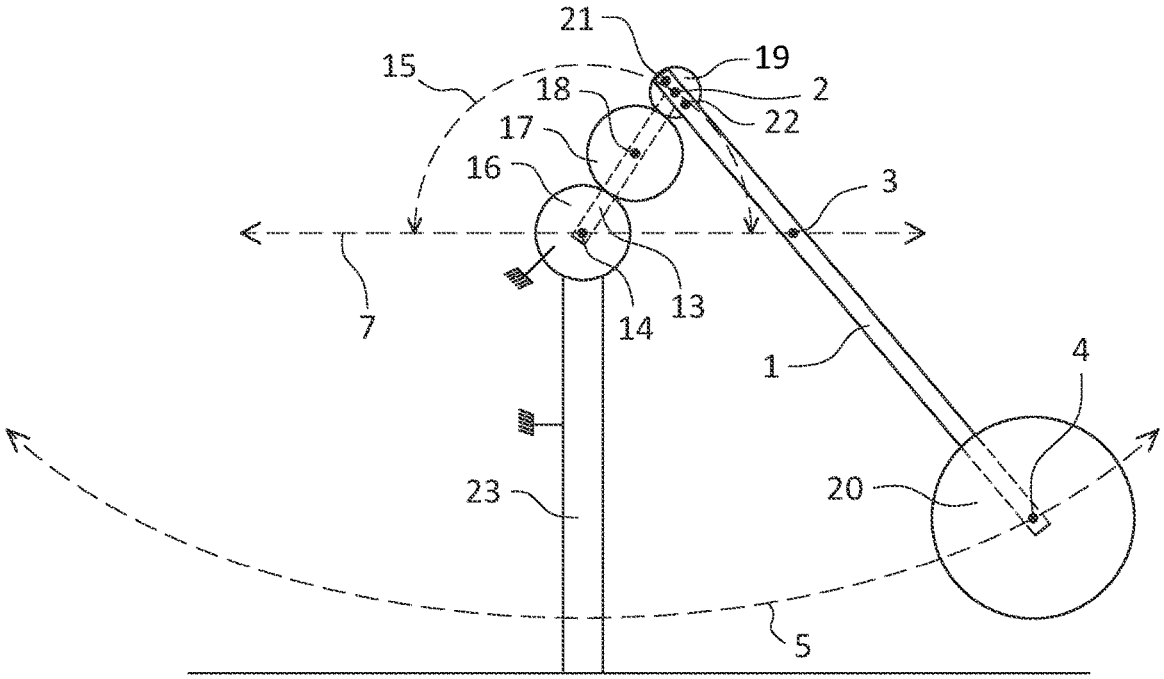
FIG. 1—illustrates a possible embodiment of the pendulum device object of the present invention with "external" gears tracing horizontal line with harmonic motion.

With particular reference to FIG. 1, the pendulum device has an arm 13 supported by the support 23 and has a rotation fulcrum in the point 14 and supports the gear 17 through the pin 18, and the arm 1 through the pin 2. The arm 1 supports the mass 20 through the point 4 and is constrained with the gear 19 through the pins 21 and 22. The pendulum oscillation of the mass 20 orients the gear 19 and rotates the gear 17 and the pulley arm 13 around the gear 16. As a result of the oscillation path 5 of the mass 20, the segment 13 makes a rotation 15 around the pin 14 and the point 3 makes a straight path 7.

Figure 2A:
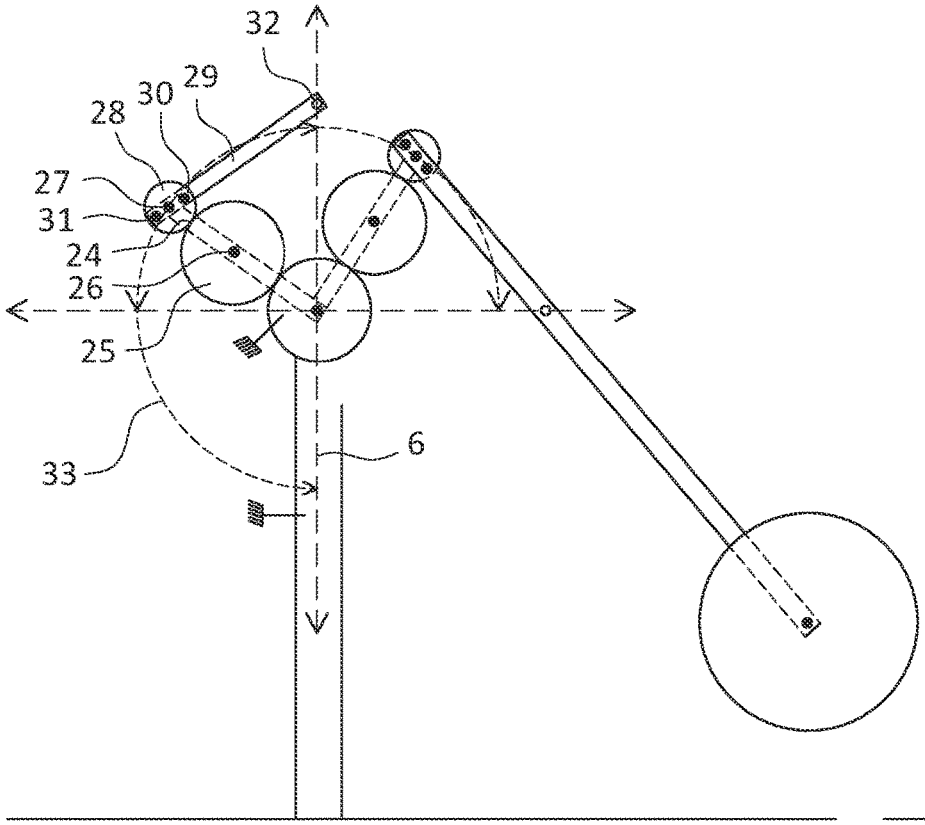
FIGS. 2A and 2B—illustrate two views of a possible embodiment of the pendulum device of the present invention with "external" gears, tracing horizontal and vertical lines with harmonic motion.

Advantageously, according to the configuration of FIG. 1, the counterweight forms a third type of lever, while the driving of the wheels involves a double-arm driving. In FIG. 2A, the pendulum device is completely similar to that of FIG. 1, integrated with the arm 24 integral with the segment 13 with an angle of 90°, which supports the gear 25 with fulcrum 26 and the gear 28 with fulcrum 27: the oscillation of the mass 20 and the consequent rotation of the arms 13 and 24 orient the arm 29 integral with the gear 28 through the pins 30 and 31, allowing at the point 32 to travel the vertical trajectory 33 with a straight line orthogonal to the trajectory 7.

Figure 2B:
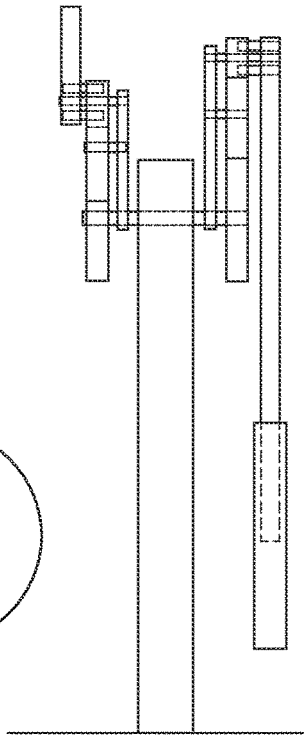

In FIG. 2B, as in the other figures with the reference "B", it is possible to see a side view of the pendulum device of FIG. 2A, so as to illustrate how the various components can be organized and installed, and explain how they are connected to each other.

Preferably the arm 24 forms a first type of lever and the counterweight is formed by an extension beyond the fulcrum 14. The arm 13 is a third-type lever and should preferably be weighed down.

The driving of the wheel trains involves a double-arm driving.

Figure 3A:
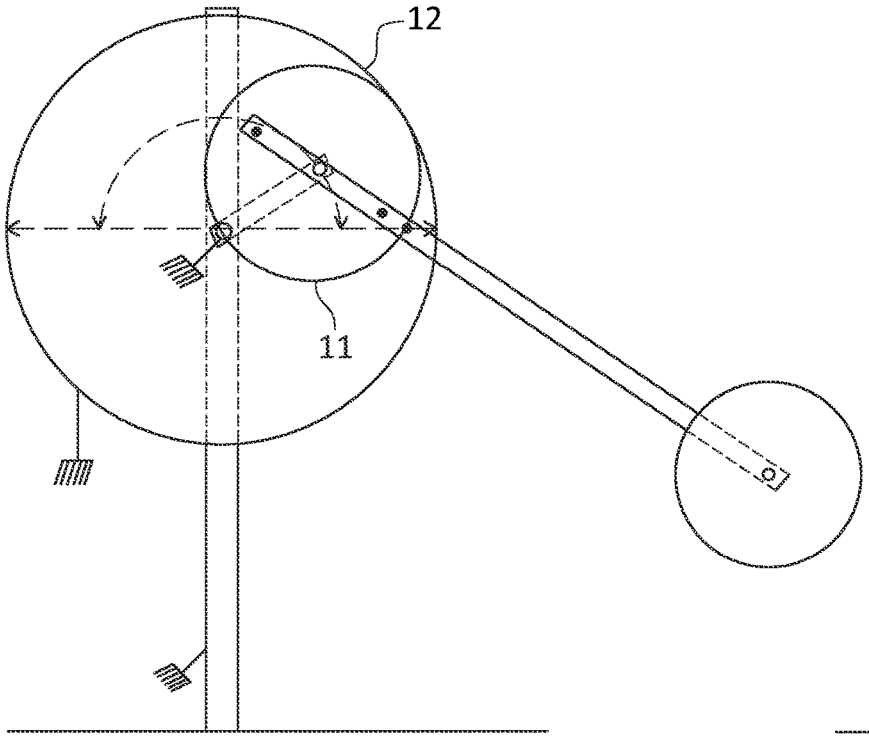
FIGS. 3A and 3B—illustrate two views of a possible embodiment of the pendulum device of the present invention with "internal" gears, tracing a horizontal line with harmonic motion.
Figure 3B:
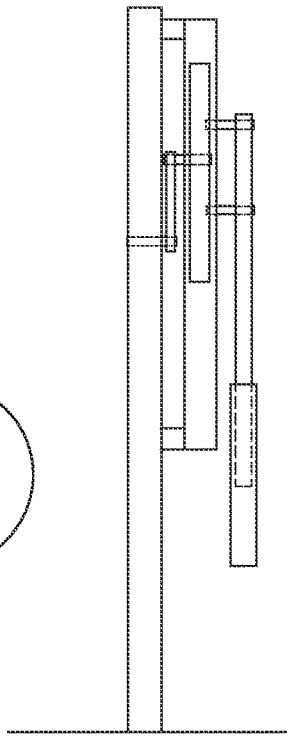

FIG. 3A illustrates a possible embodiment of the transmission means with respect to FIGS. 1 and 2A.

In fact, in the previous figures the transmission means consisted of a gear train 16, 17 and 19, while in FIG. 3A the transmission means comprise the crown 12 and the gear 11.

The crown 12 is fixed, while the gear 11 engages in the inner toothing of the crown 12 and slides along the inner circumference of said crown 12.

The proximal arm is constrained to the gear 11, such that the oscillation of the oscillating mass causes the movement of the various parts, in the manner described in FIG. 1, i.e., the segment 13 carries out a rotation 15 around the pin 14 and the point 3 a straight path 7.

As anticipated, the illustrated possible embodiments are subdivided according to the embodiment of the transmission means, i.e., whether they use "external" gears, FIGS. 1, 2A, 5A, 6A, 10A, 14A, or "internal" gears, FIGS. 3A, 4A, 7A, 8A, 9A, 11, 12, 13A.

Depending on the various connections of the arms and gears, illustrated in the various figures, point 3 belonging to the proximal arm (FIG. 2A) may perform one or more rectilinear translations and the distal arm perform more or less wide oscillations (see for example FIGS. 4A and 5A), but the oscillating mass will always perform a cycloidal trajectory.

Figure 13A:
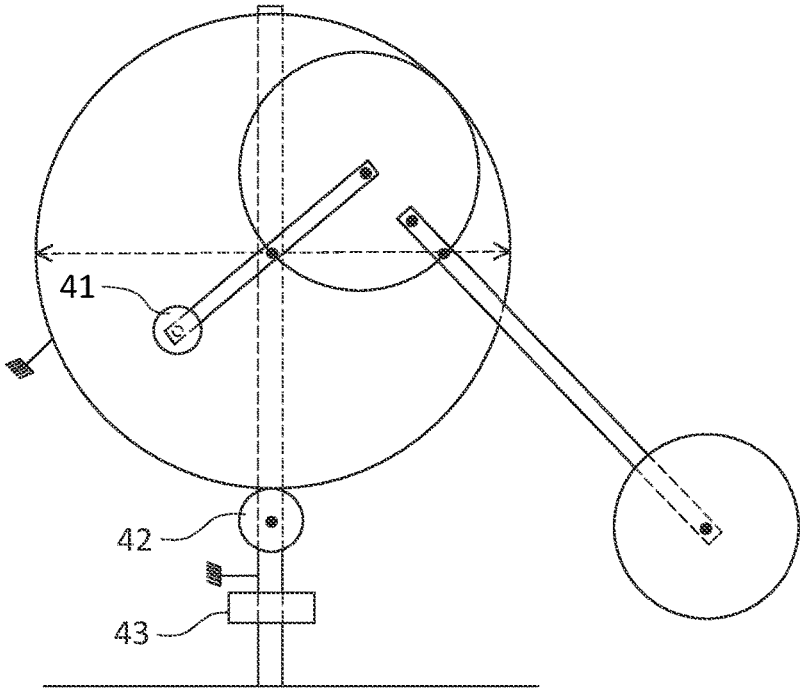
FIGS. 13A and 13B—illustrate two views of a possible embodiment of the pendulum device object of the present invention with "internal" gears and with balanced arm and auxiliary movement by rotation of the "crown" gear.
Figure 13B:
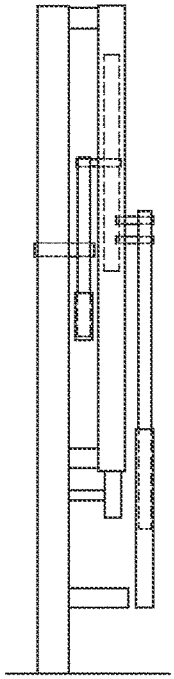

With particular reference to FIG. 3A, as for FIG. 13A, the counterweight allows to obtain the configuration of a third-type lever in which, if the mass of the gear 11 is predominant with respect to that of the arm 1, it is counterweighted as a first-type lever with respect to the fulcrum 14.

The driving of the wheel gears requires that the wheel train 11 must be driven by a double arm 13.

Figure 4A:
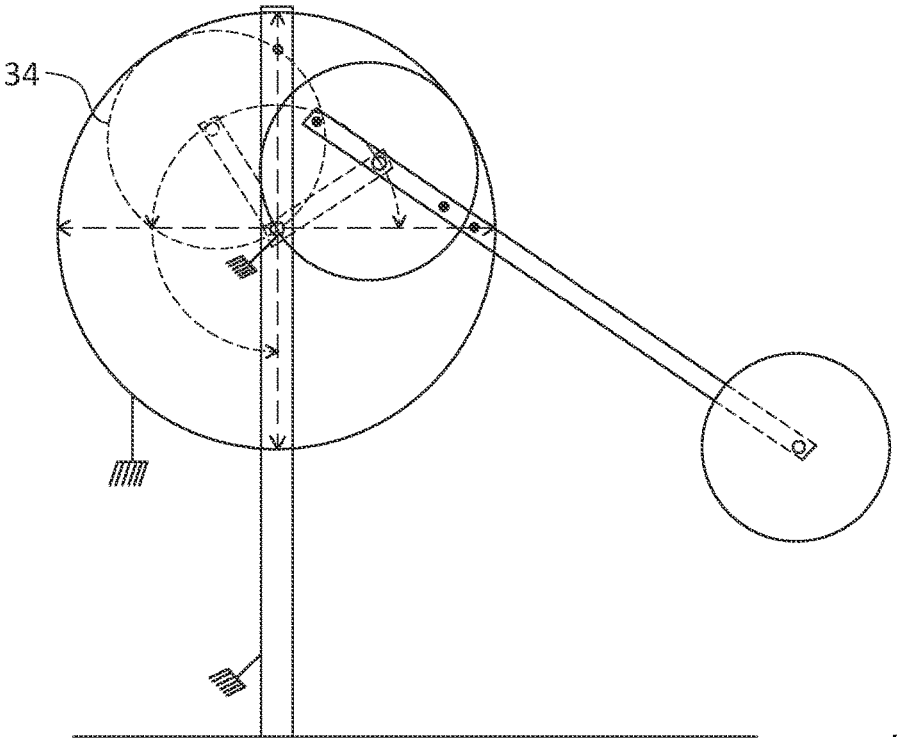
FIGS. 4A and 4B—illustrate two views of a possible embodiment of the pendulum device of the present invention with "internal" gears, tracing horizontal and vertical lines with harmonic motion.
Figure 4B:
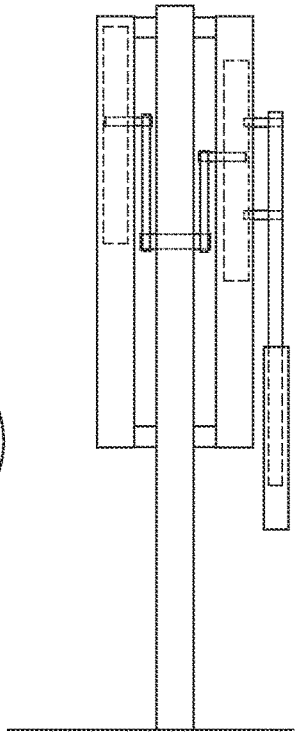

Referring to FIG. 4A, the arm 24 is a first-type lever and the counterweight is an extension beyond the fulcrum 14; depending on the mass of the gear 11, the arm 13 must be counterweighted as a first-type lever, extending it beyond the fulcrum 14. The driving of the wheel trains involves the wheel trains 11 and 34 being driven by respective double arms.

Figure 5A:
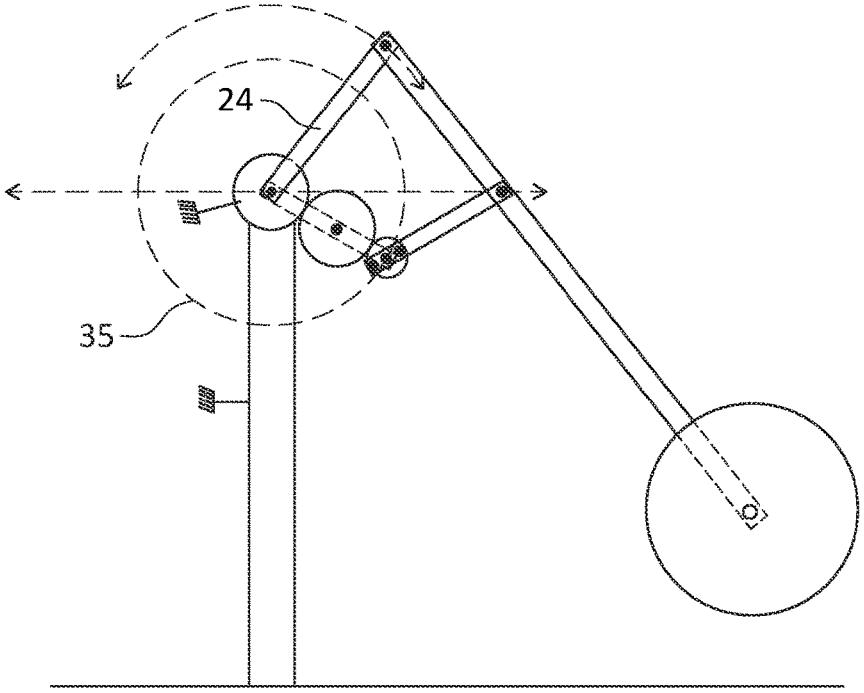
FIGS. 5A and 5B—illustrate two views of a possible embodiment of the pendulum device object of the present invention with "external" gears, tracing horizontal line with harmonic motion and rotational movement with constant motion.
Figure 5B:
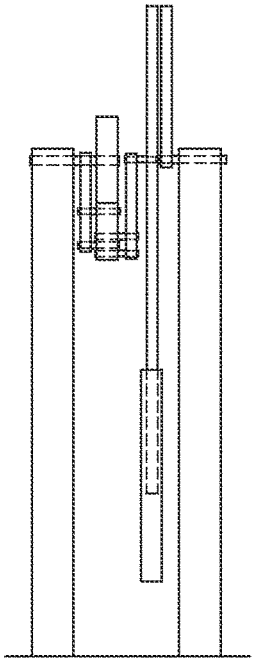

In FIG. 5A, the distal arm 24 is preferably formed by a wheel train. The arm 24 is a third-type lever whose mass is balanced with that of the arm 1. The arm 13 which drives the toothed wheels is a first-type lever to be counterbalanced beyond the fulcrum 14. The driving of the wheel trains is carried out by a double arm.

Figure 10A:
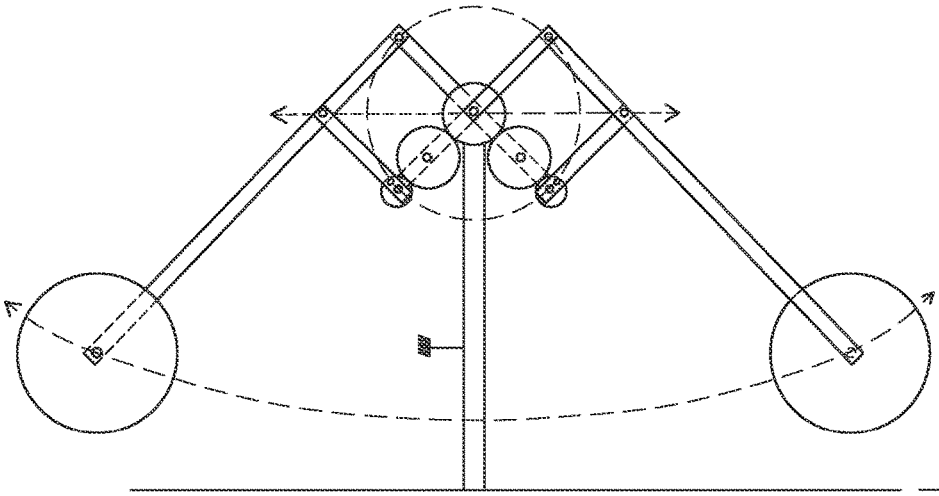
FIGS. 10A and 10B—illustrate two views of a possible embodiment of the pendulum device of the present invention consisting of a double pendulum with "external" gears tracing horizontal lines with harmonic motion and rotational motion with constant motion and constant driving torque.
Figure 10B:
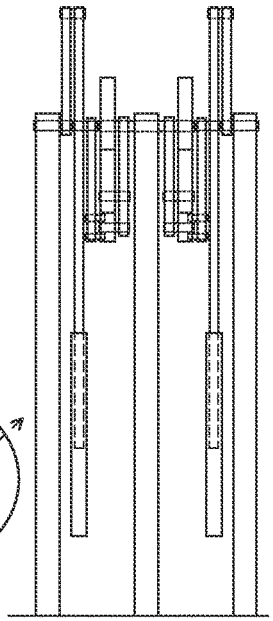

Similar considerations apply for FIG. 10A.

Figure 6A:
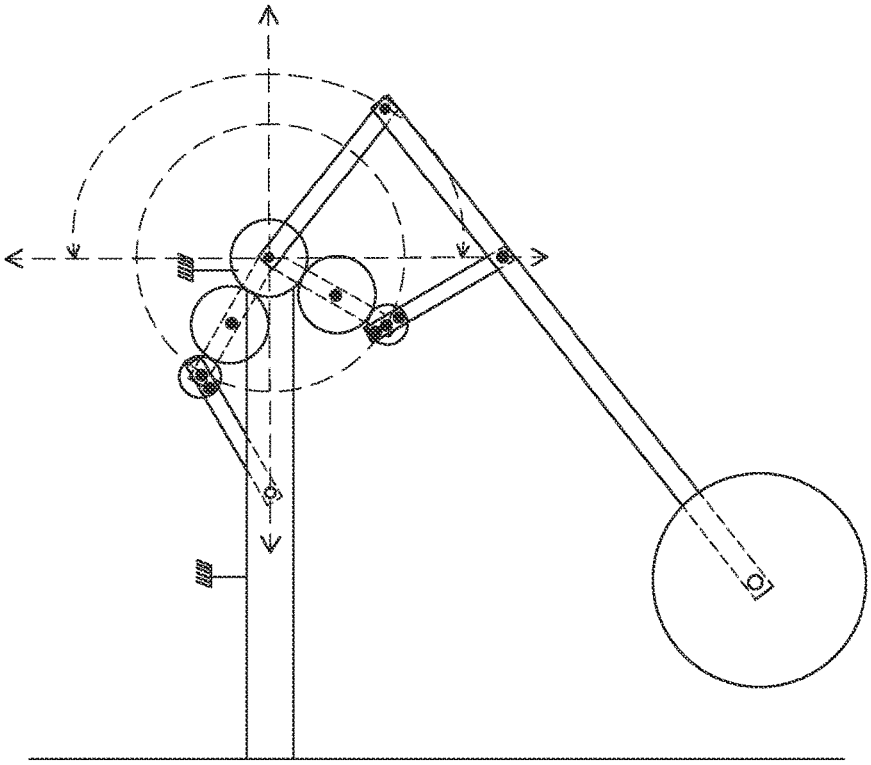
FIGS. 6A and 6B—illustrate two views of a possible embodiment of the pendulum device object of the present invention with "external" gears, tracing horizontal and vertical lines with harmonic motion and rotational movement with constant motion.
Figure 6B:
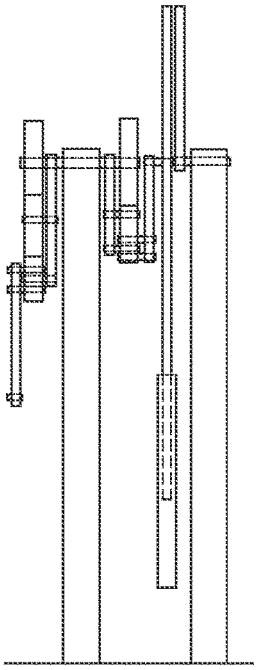

Similarly, FIG. 6A includes that the added arm 24 is a first-type lever to be counterbalanced beyond the fulcrum 14. The driving of the wheel trains requires that both trains are driven by respective double arms.

Figure 7A:
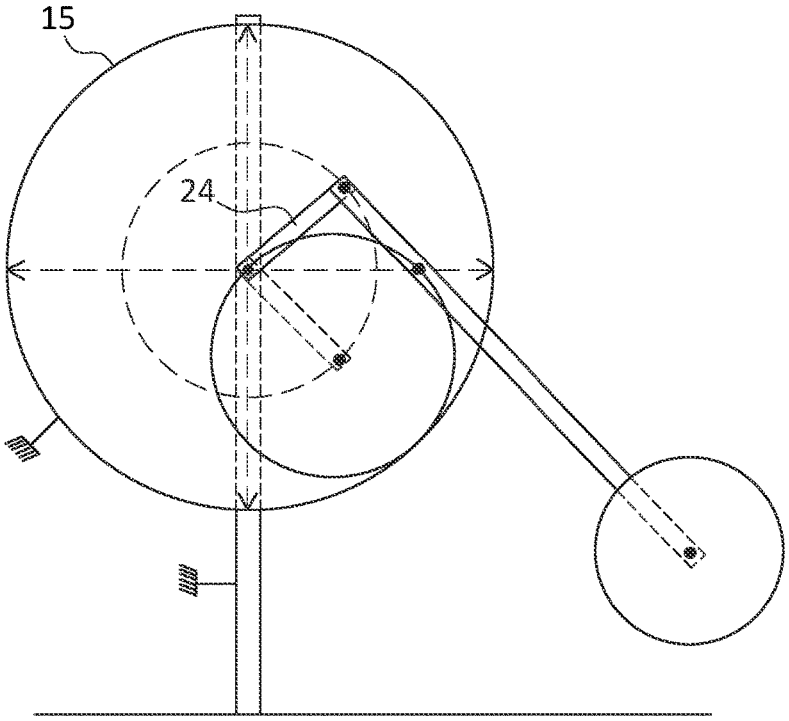
FIGS. 7A and 7B—illustrate two views of a possible embodiment of the pendulum device object of the present invention with "internal" gears tracing horizontal and vertical lines with harmonic motion and rotational motion with constant motion.
Figure 7B:
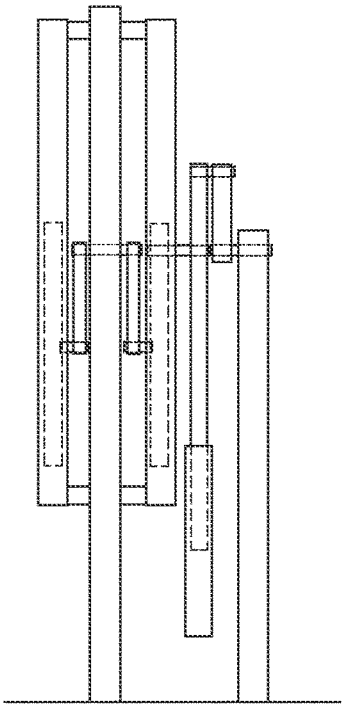

In FIG. 7A, the distal arm 24 is preferably formed by a wheel train. With regard to the counterweights, the internal rotation 11 is a first-type lever while the arm 24 is a third-type lever. The driving of the wheel trains requires the wheel trains 11 to be driven by a double arm.

Figure 8A:
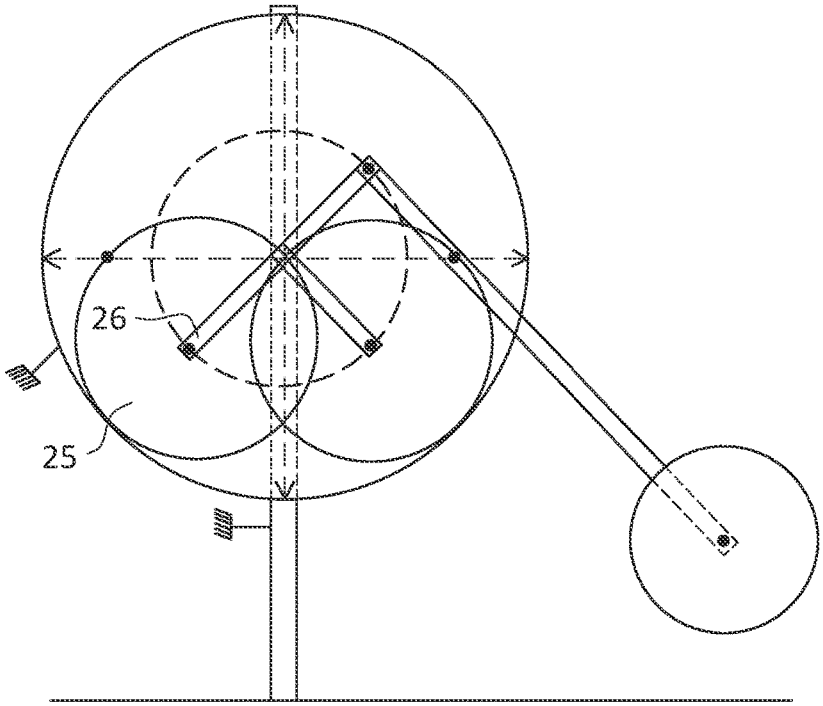
FIGS. 8A and 8B—illustrate two views of a possible embodiment of the pendulum device object of the present invention with "internal" gears tracing horizontal and vertical lines with harmonic motion and rotational movement with constant motion.
Figure 8B:
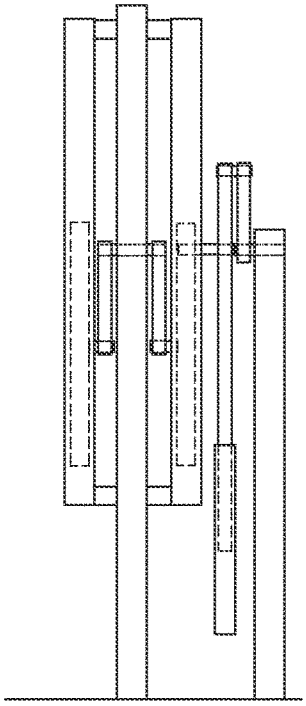

According to the configuration of FIG. 8A, the distal arm 24 is preferably formed by a wheel train, while the two internal wheels 11 and 25 form a first-type lever to be counterbalanced beyond the fulcrum 14, while the arm 24 is a third-type lever. The wheel trains 11 and 25 are driven by respective double arms.

Figure 9A:
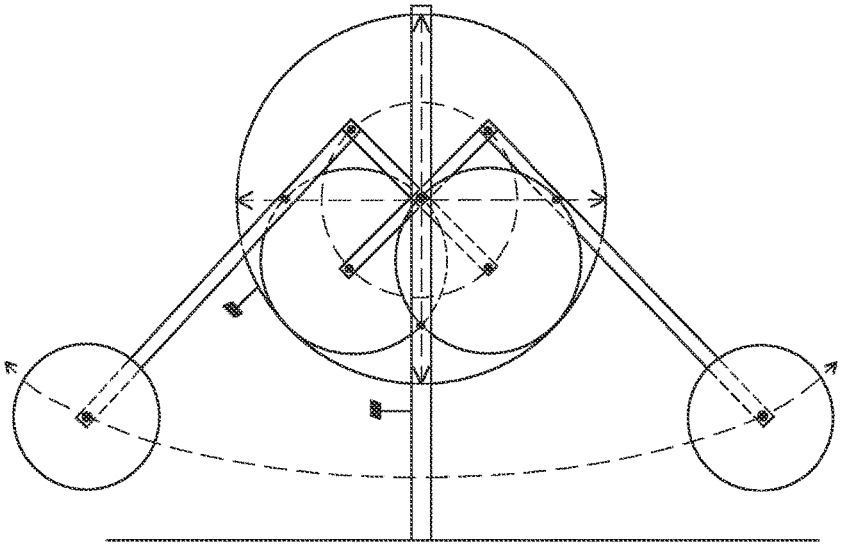
FIGS. 9A and 9B—illustrate two views of a possible embodiment of the pendulum device of the present invention comprising a double pendulum with "internal" gears tracing horizontal and vertical lines with harmonic motion and rotational motion with constant motion and constant driving torque.
Figure 9B:
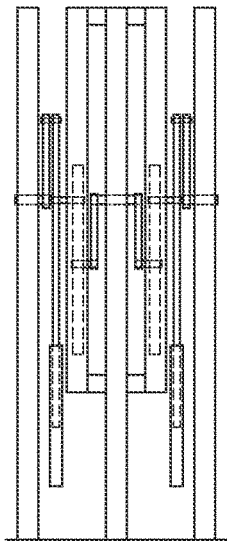
Figure 11:
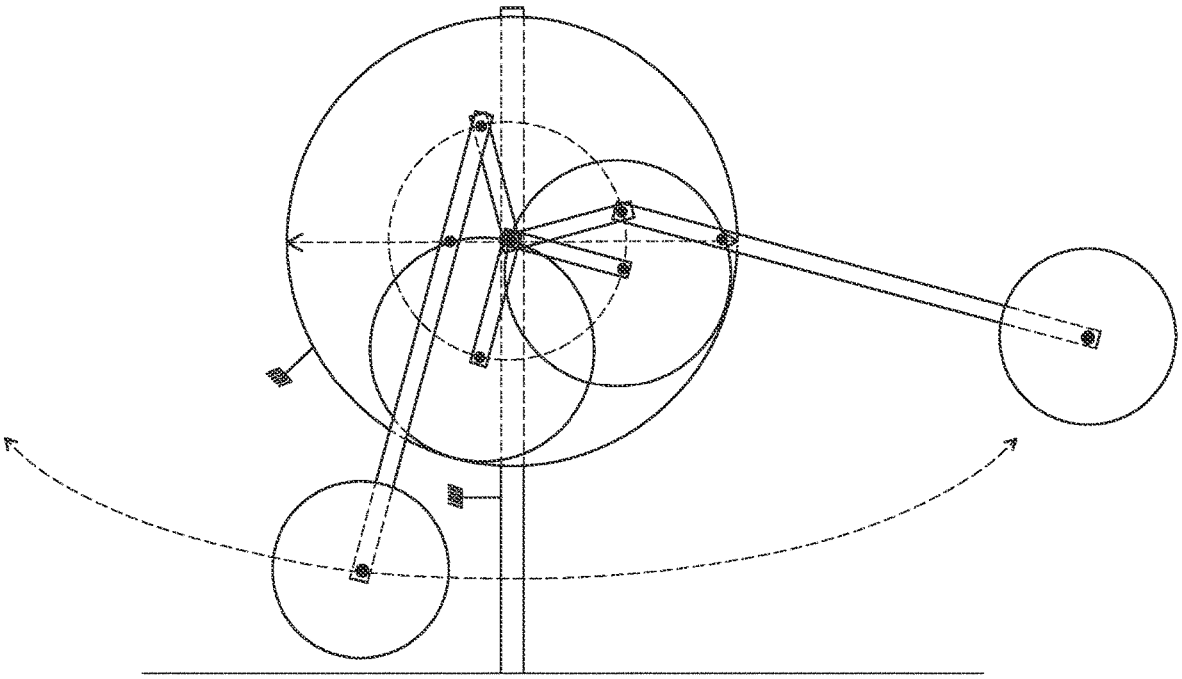
FIG. 11-12—illustrate some examples of movement of the pendulums of FIGS. 9A and 9B.
Figure 12:
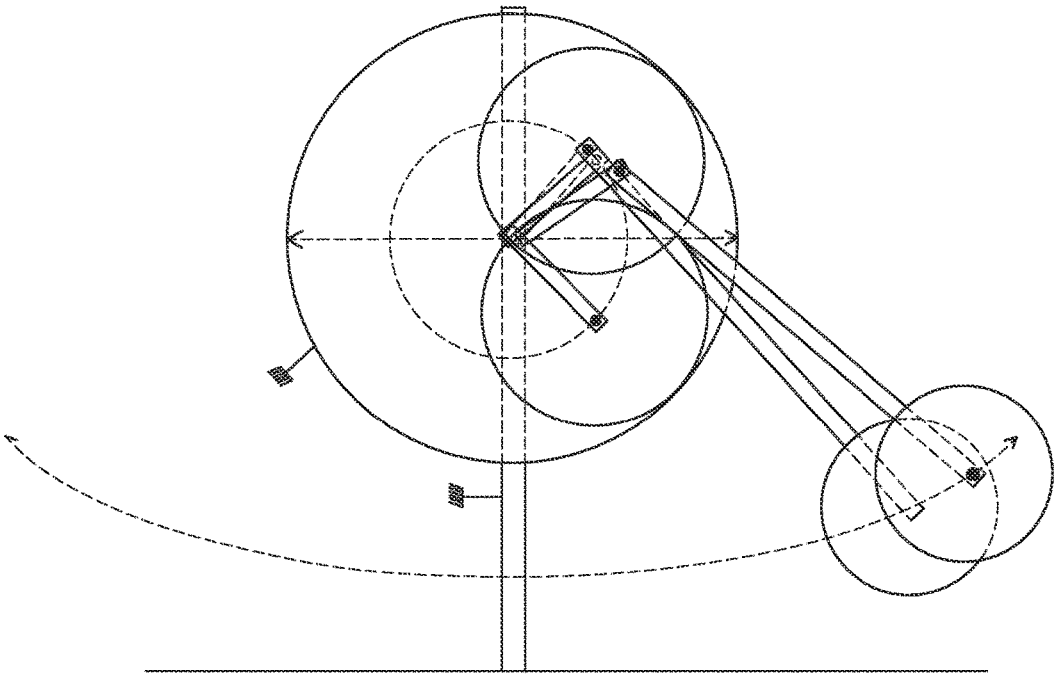

With regard to FIGS. 8A and 9A, as well as FIGS. 11 and 12, the distal arm consists of a wheel train. The wheel trains form a first-type lever and the distal arms 24 form third-type levers. The wheel trains 11 and 25 are driven by respective double arms.

Preferably, with particular reference to FIG. 13A, the wheel train 11 is driven by a double arm.

The figures therefore show possible configurations to obtain such a trajectory, both with one and with two oscillating masses, as illustrated in FIGS. 9A, 10A, 11 and 12.

Figure 14A:
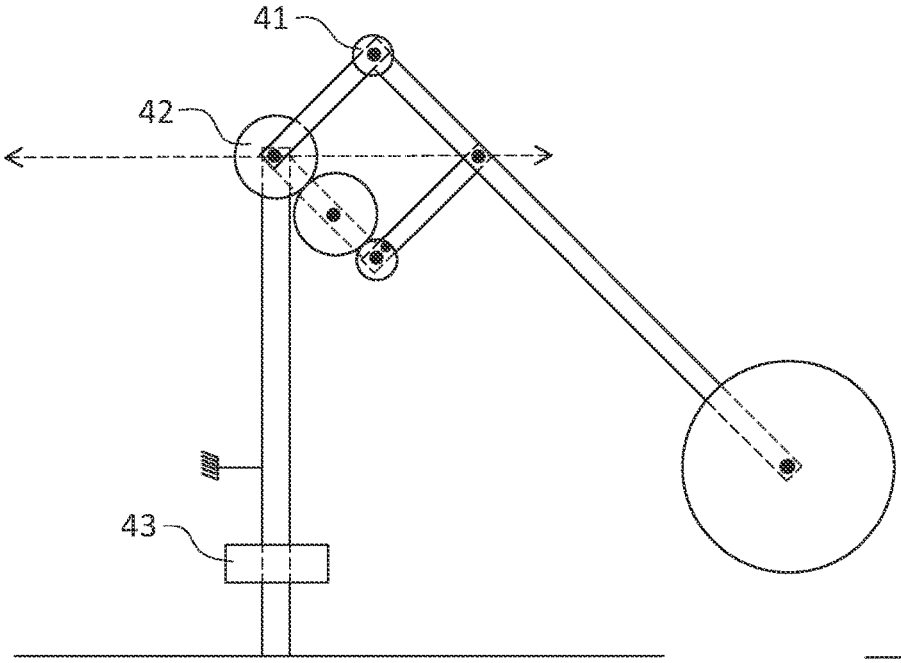
FIGS. 14A and 14B—illustrate two views of a possible embodiment of the pendulum device object of the present invention with "external" gears and with balanced arm and auxiliary movement by rotation of the "sun" gear.
Figure 14B:
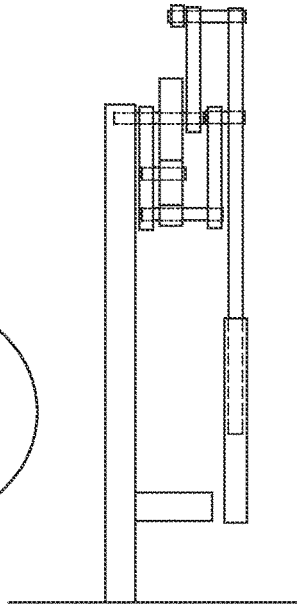
Figure 15A:
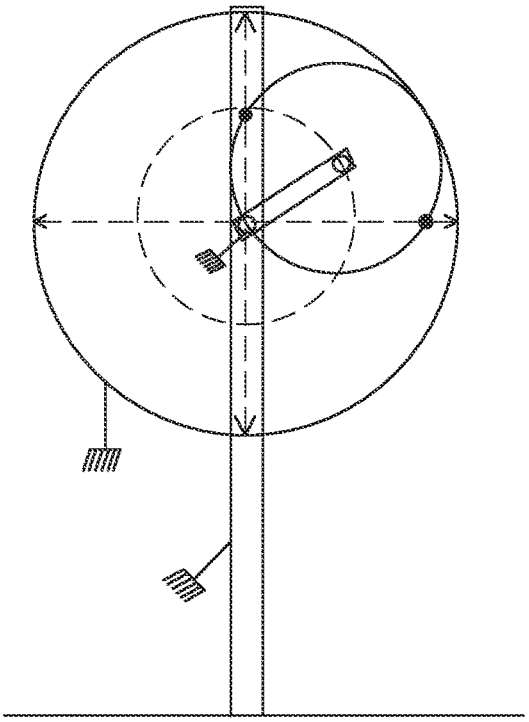
FIGS. 15A and 15B and FIGS. 16A and 16B—illustrate some views of an "internal" gear inverter.
Figure 15B:
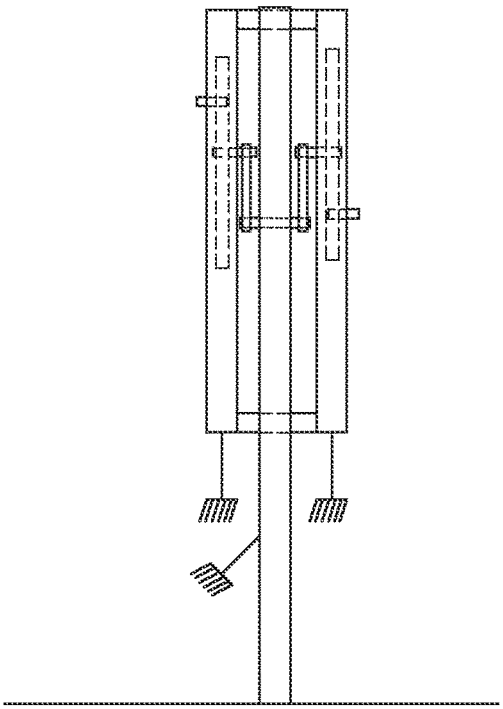

In particular, FIGS. 13A and 14A illustrate two possible variants of the pendulum device object of the present invention, respectively with "internal" gears and with "external" gears, in which the distal arm has a weight 41.

Such a weight 41 is intended to balance the masses, so that the resulting oscillating mass is almost only the oscillating mass and not the mass of the arms.

The weight 41 therefore has a value preferably equal to the weight of the arms and gears.

Furthermore, the friction compensation system, shown with the reference numeral 42, is illustrated in such figures.

Such a friction compensation system, i.e., the loss of kinetic energy by the oscillating mass, provides a rotation, continuous or discrete over time, to the external crown of FIG. 13A or to the gears of FIG. 14A.

Furthermore, such a system, as described above, may operate in combination with oscillating mass position detection sensors, such as the number 43 of FIGS. 13A and 14A.

Finally, FIGS. 15A and 15B, and FIGS. 16A and 16B illustrate some possible embodiments of inverters, operable by pendulum torque with horizontal and vertical harmonic movements, producing rotational movement with constant motion and constant driving torque.

Figure 16A:
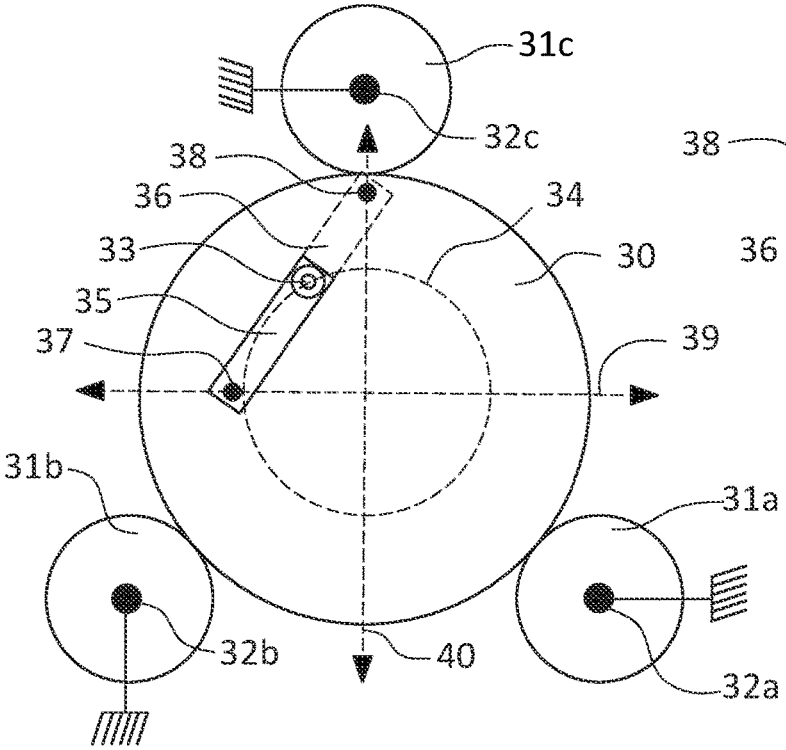

In particular, FIG. 16A illustrates a reciprocal conversion device between two alternating linear motions, orthogonal to each other, and a rotary motion. The rotary torque 30 is centred through the gears 31*a*, 31*b* and 31*c*, with the respective fulcrums 32*a*, 32*b* and 32*c*, and is crossed orthogonally by the rotating pin 33, to which the segments 35 and 36 are integral. One end of the segment 35 may be provided integral with the point belonging to the proximal arm of the pendulum having vertical linear motion, while one end of the segment 36 may be fixed to the point of the cycloidal pendulum with horizontal linear motion.

Figure 16B:
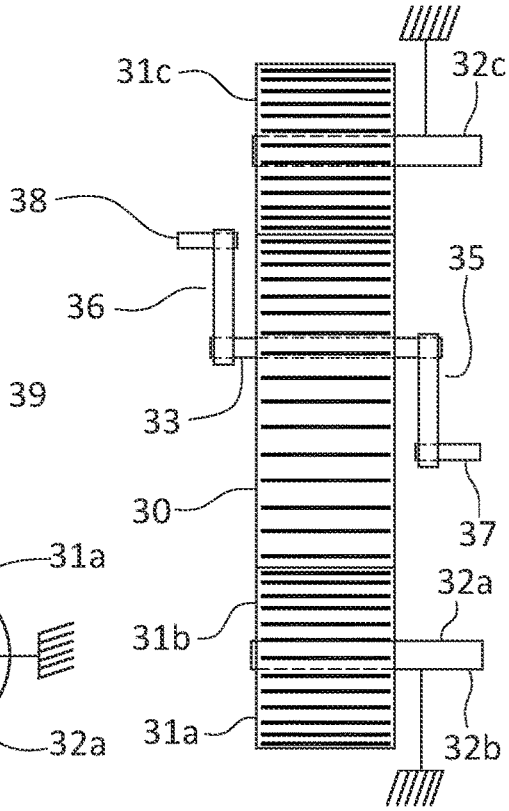

FIG. 16B illustrates the cross-section of the device of FIG. 16A.

The application of motion with harmonic trends to the points 37 and 38 induces the constant rotation of the pin 33, the wheel 30 and the wheels 31*a*, 31*b* and 31*c*. Reciprocally, a constant rotational motion imprinted at one or more of the wheels 31*a*, 31*b* and 31*c* induces the point 33 to a circular motion with constant speed and the points 37 and 38 to linear motions orthogonal to each other and harmonic velocities.

Based on what has been described and on experimental tests related to obtaining the device object of the present invention, it is possible to outline some fundamental features:

the distal arm in each configuration is intended to consist of a gear train as in FIG. 1;

The fulcrum of each toothed wheel is considered to be held by two parallel arms located at the ends of the rotation pin;

the configurations whose distal arm is attributable to a third-type lever, the centre of gravity of the mass of the distal arm is considered to be in equilibrium with that of the proximal arm, without the oscillating mass 20. This balance is similar to that of a first-type lever when the mass of the distal arm exceeds that of the proximal arm (see FIG. 13A);

the wheel trains attributable to a first-type lever are placed in an indifferent rotational equilibrium with masses opposite the rotation fulcrum;

the coupled levers (see FIGS. 5A, 6A, 7A, 8A, 9A, 10A, 11 and 12A), attributable to different types of levers, are intended to be placed in equilibrium individually, with regard to each mass, or overall.

Furthermore, based on the attached images and the previous description, it can be seen that the device object of the present invention has the following advantageous aspects:

kinetic energy input necessary for continuous operation total kinetic energy availability.

In particular, in the configurations shown in FIG. 5A to FIG. 12B, the continuous movement of the device requires the kinetic energy necessary to compensate for mechanical and aerodynamic frictions resulting from the motion of the kinematic mechanisms.

According to these configurations, the contribution is made by means of constant rotational energy, which has the same characteristic as the total kinetic energy obtained.

In detail, in FIG. 5A the contribution of kinetic energy is obtained through the constant rotation of the wheel train 17 and/or the wheel train 19 and/or the arm 13 and/or the fulcrum pin 14. Such elements also make it possible to obtain the availability of total kinetic energy.

In FIG. 6A the contribution of kinetic energy is obtained through the constant rotation of the wheel train 17 and/or wheel train 19 and/or wheel train 25 and/or wheel train 28 and/or arm 13 and/or arm 24 and/or fulcrum pin 14. Such elements also make it possible to obtain the availability of total kinetic energy.

In FIG. 7A the contribution of kinetic energy is obtained through the constant rotation of the wheel train 11 and/or wheel train 15 and/or arm 13 and/or fulcrum pin 14. Such elements also make it possible to obtain the availability of total kinetic energy.

In FIGS. 8A and 9A the contribution of kinetic energy is obtained through the constant rotation of the wheel train 11 and/or wheel train 25 and/or wheel train 15 and/or arm 13 and/or the arm 26 and/or fulcrum pin 14. Such elements also make it possible to obtain the availability of total kinetic energy.

Finally, in FIG. 10A the contribution of kinetic energy is obtained through the constant rotation of the wheel trains 17 and/or wheel trains 19 and/or arms 13 and/or fulcrum pin 14. Such elements also make it possible to obtain the availability of total kinetic energy.

While the invention is susceptible to various modifications and alternative constructions, some preferred embodiments have been shown in the drawings and described in detail.

It should be understood, however, that there is no intention of limiting the invention to the specific illustrated embodiment but, on the contrary, it aims to cover all the modifications, alternative constructions, and equivalents falling within the scope of the invention as defined in the claims.

The use of "for example", "etc.", "or" refers to non-exclusive non-limiting alternatives, unless otherwise stated.

The use of "includes" means "includes but not limited to", unless otherwise stated.

The invention claimed is:

1. A pendulum device comprising:

at least one oscillating mass;

at least one proximal arm; and at least one first distal arm, wherein said proximal arm is fixed to said oscillating mass at one end and is rotatably connected to the distal arm at the other end, so that said oscillating mass can oscillate with respect to said distal arm; and wherein the distal arm is rotatably fixed to a support element fixed through a fulcrum point; and wherein a transmission means is included between the distal arm and the proximal arm, the transmission means being configured so that oscillation of said mass causes the rotation of the distal arm around the fulcrum point and so that at least one point of said proximal arm performs at least a linear translation, said mass performing a cycloidal trajectory.

2. The device according to claim 1, wherein the value of the distance between the connection point of the mass to the proximal arm and the connection point of the proximal arm to the distal arm is about four times the value of the distance between the connection point of the proximal arm to the distal arm and the connection point between the distal arm and the support element.

3. The device according to claim 1, wherein a reversal means of the motion of the mass is included, the reversal means being configured so that said point on the proximal arm performs two linear translations oriented perpendicular to each other.

4. The device according to claim 1, wherein said transmission means comprises a first gear included at the connection between the proximal arm and the distal arm, said first gear being integral with the proximal arm, which first gear engages with a second gear rotatably fixed to the distal arm which engages in turn with a third gear included at the connection area between the distal arm and the support element.

5. The device according to claim 1, wherein the transmission means comprises a first gear engaging with a crown having an internal toothing, said first gear being integral with the proximal arm and the crown being integral with said support element and said distal arm being rotatably fixed to the support element.

6. The device according to claim 5, wherein the diameter of said crown is about twice the diameter of the first gear.

7. The device according to claim 1, wherein said support element is connected to at least two distal arms, each distal arm being connected to a proximal arm to which the oscillating mass is fixed, wherein said transmission means being included between each distal arm and the corresponding proximal arm.

8. The device according to claim 1, wherein the distal arm has a weight at the end opposite the end facing the proximal arm.

9. The device according to claim 1, wherein movement means of said oscillating mass is included.

10. The device according to claim 1, wherein a device for detecting the speed and/or position of said oscillating mass is present.

* * * * *